US009956491B2

(12) United States Patent
McCafferty et al.

(10) Patent No.: US 9,956,491 B2
(45) Date of Patent: May 1, 2018

(54) STUNT FIGURE FOR ATTACHING WITH A MOBILE TOY TO ALLOW FOR PERFORMANCE OF A STUNT

(75) Inventors: Jim McCafferty, Santa Ana, CA (US); Dominic Laurienzo, Los Angeles, CA (US); Michael Bernstein, Hermosa Beach, CA (US); Gabriel Carlson, Los Angeles, CA (US); Greg Leong, Irvine, CA (US); Steven Douglas DeLacy, Santa Ana, CA (US)

(73) Assignee: JAKKS PACIFIC, INC., Santa Monica, CA (US)

( * ) Notice: Subject to any disclaimer, the term of this patent is extended or adjusted under 35 U.S.C. 154(b) by 432 days.

(21) Appl. No.: 12/662,262

(22) Filed: Apr. 21, 2010

(65) Prior Publication Data

US 2011/0003532 A1 Jan. 6, 2011
US 2017/0266573 A9 Sep. 21, 2017

Related U.S. Application Data

(63) Continuation-in-part of application No. 12/660,238, filed on Feb. 22, 2010, now Pat. No. 8,562,386, which (Continued)

(51) Int. Cl.

*A63H 17/25* (2006.01)
*A63H 29/20* (2006.01)
*A63H 7/04* (2006.01)

(52) U.S. Cl.

CPC ..... *A63H 7/04* (2013.01); *A63H 17/25* (2013.01); *A63H 29/20* (2013.01)

(58) Field of Classification Search

CPC ..... A63H 17/00; A63H 17/004; A63H 17/24; A63H 17/25; A63H 29/20; A63H 11/00; A63H 17/26

(Continued)

(56) References Cited

U.S. PATENT DOCUMENTS 663,506 A 12/1900 Loree
693,375 A 2/1902 Clark (Continued)

FOREIGN PATENT DOCUMENTS

GB 2186501 A * 8/1987 ..... A63H 11/10
JP 2006-314440 11/2006

OTHER PUBLICATIONS

Tech Deck Dudes: http://www2.shopping.com/xPO-Tech-Deck-Tech-Deck-Dude-Snow-Ballah-Holidude.

(Continued)

*Primary Examiner* — Gene Kim
*Assistant Examiner* — Alyssa Hylinski
(74) *Attorney, Agent, or Firm* — Tope-McKay & Associates

(57) ABSTRACT

A mobile toy and a stunt figure attachable with the mobile toy are described. In a desired aspect, the mobile toy is a skateboard-shaped toy having a skateboard deck with a flywheel positioned within the skateboard deck. The stunt figure is detachably attachable with the skateboard-shaped toy through snap-fit connection mechanisms on the skateboard-shaped toy. In a desired aspect, the stunt figure comprises at least one appendage and the stunt figure is attached with the skateboard-shaped toy through at least one appendage. The stunt figure can be formed in a variety of shapes to alter the form and center of gravity of the toy to provide for a variety of stunts.

20 Claims, 7 Drawing Sheets

Related U.S. Application Data is a continuation-in-part of application No. 12/587,625, filed on Oct. 10, 2009, now Pat. No. 8,579,674.

(60) Provisional application No. 61/195,812, filed on Oct. 10, 2008, provisional application No. 61/214,226, filed on Apr. 21, 2009, provisional application No. 61/208,169, filed on Feb. 21, 2009.

(58) Field of Classification Search
USPC ..... 446/233–235, 269, 279, 280, 288, 462
See application file for complete search history.

(56) References Cited

U.S. PATENT DOCUMENTS 837,040 A * 11/1906 Clark ..... A63H 29/20 446/462
944,096 A 12/1909 Kirkby
1,098,895 A 6/1914 Edgar
1,495,911 A 5/1923 Lemoine
1,584,979 A 5/1926 Clausen
2,124,302 A 7/1938 Lohr et al.
2,148,374 A 2/1939 Hogan
2,195,083 A 3/1940 Einfalt
2,625,831 A 1/1953 Saunders, Jr.
2,677,216 A 5/1954 Hein
2,736,132 A 2/1956 Murray
3,234,689 A * 2/1966 Ryan ..... A63H 3/46 223/68
3,318,600 A 5/1967 Glass et al.
3,603,032 A 9/1971 Heron
3,621,607 A 11/1971 Morrison
3,650,067 A 3/1972 Greenwood
3,703,048 A 11/1972 Cooper
3,726,146 A 4/1973 Mishler
3,789,540 A 2/1974 Convertine et al.
3,816,958 A 6/1974 Winston
3,826,039 A 7/1974 Disko et al.
2,932,957 A 1/1976 Morrison et al.
3,932,957 A * 1/1976 Morrison ..... A63H 17/25 446/234
3,984,939 A * 10/1976 Wolgamot ..... A63H 17/25 446/279
4,059,918 A 11/1977 Matsushiro
4,156,986 A 6/1979 Kupperman et al.
RE30,299 E 6/1980 Greenwood
4,300,308 A 11/1981 Ikeda
4,324,063 A 4/1982 Rosenwinkel et al.
4,373,290 A 2/1983 Goldfarb et al.
4,443,967 A * 4/1984 Jones ..... A63H 29/20 446/462
4,475,305 A 10/1984 Kawakami et al.
4,498,886 A 2/1985 Goldfarb et al.
4,536,168 A 8/1985 Stephens
4,556,397 A 12/1985 Arad et al.
4,593,618 A 6/1986 Lebensfeld
4,631,041 A 12/1986 Chang et al.
4,655,725 A 4/1987 Torres
4,685,894 A 8/1987 Beny et al.
4,772,241 A 9/1988 Bro et al.
4,795,181 A * 1/1989 Armstrong ..... A63C 17/004 280/87.042
4,836,819 A * 6/1989 Oishi ..... A63H 11/10 446/288
4,892,503 A 1/1990 Kumazawa
4,897,065 A 1/1990 Fertig et al.
4,982,961 A 1/1991 Ichimura
5,052,973 A 10/1991 Rudell et al.
5,087,219 A 2/1992 Price
5,165,710 A 11/1992 Runyon
5,254,030 A 10/1993 Ostendorff et al.
5,370,571 A 12/1994 Bosch
5,378,187 A * 1/1995 Forbes ..... A63H 3/50 248/224.8
5,433,641 A 7/1995 Rudell et al.
5,460,560 A 10/1995 Liu
5,643,040 A 7/1997 Hippely et al.
5,657,738 A 8/1997 Klundt
5,823,545 A 10/1998 Goeckel
5,823,845 A 10/1998 O'Berrigan
5,823,848 A 10/1998 Cummings
5,916,008 A 6/1999 Wong
5,957,214 A 9/1999 Martinez
5,957,745 A 9/1999 Johnson et al.
6,000,992 A 12/1999 Lambert
6,071,173 A 6/2000 Kelley
D431,611 S 10/2000 Dilabio et al.
6,280,286 B1 8/2001 Andrews
6,315,630 B1 * 11/2001 Yamasaki ..... A63H 11/10 446/275
6,435,929 B1 8/2002 Halford
6,475,052 B1 11/2002 Liu
6,676,476 B1 * 1/2004 Lund ..... A63H 1/20 446/234
6,676,480 B2 1/2004 Sheltman
6,682,394 B2 1/2004 Tilbor et al.
6,695,675 B1 2/2004 Ngan
6,726,523 B2 * 4/2004 Baker ..... A63H 11/10 180/181
6,733,356 B2 5/2004 Lee
6,764,374 B2 7/2004 Tilbor et al.
6,786,796 B2 9/2004 Suto
6,988,929 B2 1/2006 Wong
7,297,042 B2 * 11/2007 Whitehead ..... A63H 33/046 446/129
7,329,167 B2 2/2008 Nagasaka et al.
7,445,539 B2 11/2008 Laurienzo et al.
7,481,209 B1 1/2009 Blight et al.
7,811,217 B2 * 10/2010 Odien ..... A63B 21/0058 482/147
7,946,903 B2 * 5/2011 Sheltman ..... A63H 11/10 446/133
8,562,386 B2 * 10/2013 Carlson ..... A63H 17/26 446/431
8,579,674 B2 * 11/2013 Carlson ..... A63H 17/26 446/429
2002/0166551 A1 11/2002 Lee
2005/0016514 A1 1/2005 Nadel
2005/0181703 A1 * 8/2005 Kuralt ..... A63H 17/36 446/454
2005/0191938 A1 9/2005 Sheltman et al.
2005/0287916 A1 12/2005 Sheltman et al.
2006/0046609 A1 3/2006 Laurienzo et al.
2006/0160464 A1 7/2006 Vetudkey
2006/0211331 A1 9/2006 Trageser
2006/0211333 A1 9/2006 Laurienzo
2006/0292962 A1 12/2006 Takeyasu et al.
2007/0087651 A1 * 4/2007 Ali ..... A63H 3/50 446/137
2007/0093363 A1 4/2007 Sharps
2007/0144506 A1 6/2007 Sun et al.
2007/0197126 A1 * 8/2007 Derrah ..... A63H 7/00 446/288
2007/0207699 A1 9/2007 Hoeting et al.
2007/0293122 A1 12/2007 O'Connor et al.
2008/0020675 A1 1/2008 Ostendorff
2008/0032597 A1 2/2008 Lo
2008/0070472 A1 3/2008 Campbell
2008/0096460 A1 4/2008 Sandoval et al.
2008/0171491 A1 * 7/2008 Sheltman ..... A63H 11/10 446/429
2008/0242192 A1 * 10/2008 Derrah ..... A63H 17/24 446/279
2008/0242193 A1 10/2008 Filoseta et al.
2008/0265048 A1 10/2008 O'Connor
2010/0093256 A1 * 4/2010 Carlson ..... A63H 29/20 446/462

OTHER PUBLICATIONS

Stunt Riders: http://www.argos.co.uk/static/Product/partNumber/3881123.htm.

(56) References Cited

OTHER PUBLICATIONS

Office Action 1 for U.S. Appl. No. 12/587,625, dated Jan. 10, 2012.
Yasunaga, Nov. 2006, JP2006-314440 A, Machine Translation, pp. 1-17.
Office Action 1 Response for U.S. Appl. No. 12/587,625, dated Apr. 2, 2012.
Office Action 2 for U.S. Appl. No. 12/587,625, dated May 7, 2012.
Office Action Response for U.S. Appl. No. 12/587,625, dated Aug. 6, 2012.
Office Action 3 for U.S. Appl. No. 12/587,625, dated Nov. 13, 2012.
Office Action 3 Response for U.S. Appl. No. 12/587,625, dated Mar. 13, 2013.
Office Action 4 for U.S. Appl. No. 12/587,625, dated Apr. 9, 2013.
Office Action 4 Response for U.S. Appl. No. 12/587,625, dated Jun. 13, 2013.
Notice of Allowance for U.S. Appl. No. 12/587,625, dated Jul. 8, 2013.
Office Action 1 for U.S. Appl. No. 12/660,238, dated Feb. 28, 2011.
Office Action 1 Response for U.S. Appl. No. 12/660,238, dated May 27, 2011.
Office Action 2 for U.S. Appl. No. 12/660,238, dated Jun. 29, 2011.
Office Action 2 Response for U.S. Appl. No. 12/660,238, dated Sep. 29, 2011.
Office Action 3 for U.S. Appl. No. 12/660,238, dated Nov. 9, 2011.
Office Action 3 Response for U.S. Appl. No. 12/660,238, dated Jan. 17, 2012.
Office Action 4 for U.S. Appl. No. 12/660,238, dated May 7, 2012.
Office Action 4 Response for U.S. Appl. No. 12/660,238, dated Aug. 7, 2012.
Office Action 5 for U.S. Appl. No. 12/660,238, dated Feb. 26, 2013.
Office Action 5 Response for U.S. Appl. No. 12/660,238, dated May 28, 2013.
Notice of Allowance for U.S. Appl. No. 12/660,238, dated Jun. 25, 2013.

* cited by examiner

STUNT FIGURE FOR ATTACHING WITH A MOBILE TOY TO ALLOW FOR PERFORMANCE OF A STUNT

PRIORITY CLAIM

This is a Continuation-in-Part patent application of U.S. patent application Ser. No. 12/660,238 filed in the United States on Feb. 22, 2010, titled, "Mobile Skateboard-Shaped Toy with a Flywheel", which is a Non-Provisional patent application of U.S. Provisional Application No. 61/208,169 filed in the United States on Feb. 21, 2009, titled, "Mobile Skateboard-Shaped Toy with a Flywheel." U.S. patent application Ser. No. 12/660,238 is also a Continuation-in-Part application of U.S. patent application Ser. No. 12/587,625, filed Oct. 9, 2009, titled, "Mobile Toy with Displaceable Flywheel", which is a non-provisional patent application of U.S. Provisional Application No. 61/195,812, filed on Oct. 10, 2008. The present application is also a Non-Provisional patent application of U.S. Provisional Application No. 61/214,226, filed in the United States on Apr. 21, 2009, titled, "Stunt Figure for Attaching with a Mobile Toy to Allow for Performance of a Stunt."

BACKGROUND OF THE INVENTION

(1) Field of Invention

The present invention relates to a stunt figure and corresponding mobile toy and, more particularly, to a stunt figure for attaching with a mobile toy vehicle, with the shape of the stunt figure allowing for performance of a stunt.

(2) Description of Related Art

Stunt toys are toys that are formed to perform a particular trick or stunt. Stunt toys have long been known in the art. For example, toy airplanes have been conceived that can perform aerial stunts, such as loops. As another example, remote control vehicles have been devised that include rear weights to allow the vehicle to perform a wheelie.

While the aforementioned prior art allows a user to perform a stunt, the prior art is limited in that the vehicle itself is formed to perform the particular stunt. In other words, the shape and form the vehicle itself (e.g., car, plane, skateboard, etc.) dictates the limited stunts available to the user.

Thus, a continuing need exists for an attachment (e.g., stunt figure) for attaching with a mobile toy vehicle (e.g., skateboard), with the shape of the stunt figure allowing for performance of a stunt.

SUMMARY OF INVENTION

The present invention relates to a stunt figure and corresponding mobile toy and, more particularly, to a stunt figure for attaching with a mobile toy vehicle, with the shape of the stunt figure allowing for performance of a stunt.

In another aspect, the mobile toy vehicle is a skateboard-shaped toy having a skateboard deck with a flywheel positioned within the skateboard deck.

In another aspect, the stunt figure is detachably attachable with the skateboard-shaped toy.

In another aspect, the stunt figure is detachably attachable with the skateboard-shaped toy via a connection mechanism.

In another aspect, the connection mechanism is a snap-fit mechanism.

In another aspect, the stunt figure comprises at least one appendage, and the stunt figure is attached with the skateboard-shaped toy via the at least one appendage.

In another aspect, the skateboard-shaped toy further comprises a frame attached with the skateboard deck and at least one channel in the frame for receiving at least a portion of the at least one appendage of the stunt figure.

Finally, the present invention also comprises a method for forming and using the device described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a stunt figure and corresponding toy vehicle and, more particularly, to a stunt figure for attaching with a mobile toy vehicle, with the shape of the stunt figure allowing for performance of a stunt. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
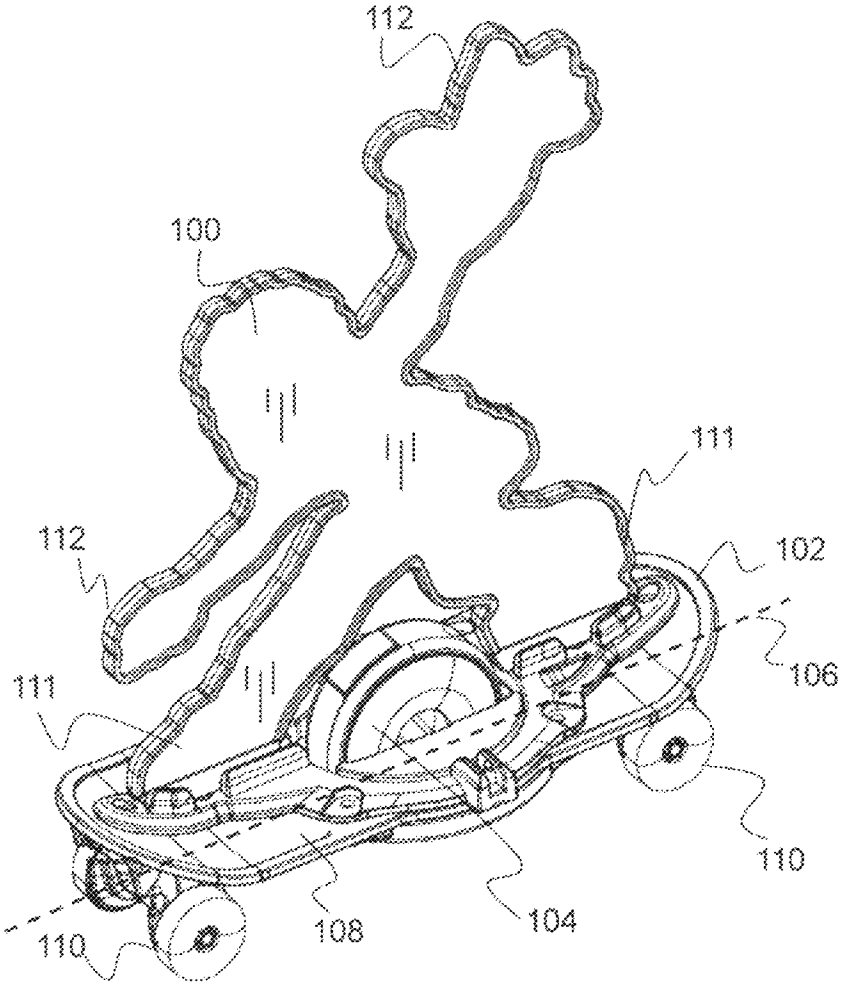
FIG. 1 illustrates a perspective-view of a stunt figure attached with a mobile toy according to the present invention, depicting the mobile toy and stunt figure in a form to allow the stunt figure to perform a "wheelie" and/or "tumbles"

As shown in FIG. 1, the present invention relates to a stunt figure 100 for attaching with a mobile toy 102, with the shape of the stunt figure 100 allowing for performance of a stunt. Although the present invention is not intended to be limited thereto, FIGS. 1-7 depict the mobile toy 102 in the shape of a miniature skateboard powered with a flywheel 104. The mobile toy 102 can be formed to represent any mobile vehicle, non-limiting examples of which include a skateboard, car, plane, bicycle, boat, animal, etc. Further, to allow the mobile toy 102 to perform a stunt, it needs some form of an intrinsic power source to cause motion to the mobile toy 102 and/or stunt figure 100. Non-limiting examples of such intrinsic power sources include a motor and a flywheel 104.

In the event of a flywheel 104, the flywheel 104 is a weighted wheel positioned within the mobile toy 102. The flywheel 104 is powered using any suitable mechanism or device for providing a high-rate of angular momentum to the flywheel 104, a non-limiting example of which includes using a rip cord that is engageable with gears that are affixed with the flywheel 104. For example, pulling a ripcord along the gears will cause the flywheel 104 to rotate at a high-rate of speed.

Further, the flywheel 104 can be removable or fixed. Additionally, the direction of the flywheel 104 can be rotated within the skateboard (i.e., mobile toy 102) to change a rotation direction with respect to a long axis 106 of the mobile toy 102. For example, the flywheel can be rotated such that its axis of rotation is aligned with the long axis. This orientation places the central axis of rotation at the tail and nose of the skateboard, allowing the mobile toy to appear to balance and spin on the tail or nose as a result of the gyroscopic action of the flywheel and the form and position of the stunt figure. With the flywheel spinning, the skateboard can be coaxed into a number of tricks and balancing effects.

As noted above and illustrated in FIG. 1, the mobile toy 102 can be designed with a repositionable flywheel 104 in the approximate center of a skateboard deck 108 of the mobile toy 102, ideally (although not required) biased to one end to a certain degree. The flywheel 104 is attachable with the mobile toy 102 in any suitable manner that allows it to be repositionable. As a non-limiting example, the flywheel 104 is housed independently in a 'turntable' that is inserted into a 'bezel' or frame in the skateboard. This system allows the flywheel 104 to be removable as well as repositioned in a variety of locations and orientations. Of course, the flywheel 104 can be placed in a fixed position allowing the same performance. Several desired features are described below.

The flywheel 104 is formed through any suitable technique and of any suitable material. As a non-limiting example, the flywheel 104 is insert-molded with different materials that have different performance attributes. Hard plastic allows the flywheel 104 to get limited traction, allowing it to slip and slide, drift, as well as continue to spin when in contact with a surface thus keeping its gyroscopic balancing effect even as it continues to perform other actions. A softer material will allow the wheel to gain greater traction and therefore speed in a certain direction.

Tread patterns and other moldable design features and performance enhancing shapes and details can be molded into the flywheel 104. Molded bumps allow the board to hop and jump as the shapes come into contact with the ground. A groove around the tire will allow the flywheel to balance and travel on a string, wire, or thin rail. A smooth wheel will allow the board to travel "backwards" and then return as the wheel slowly gains traction. It will also travel up one side of a half pipe and then return, thereby gaining traction again and traveling back up the other side.

FIG. 1 depicts the flywheel 104 aligned such that it rotates in a direction that is aligned with the long axis 106 of the mobile toy 102. Such an alignment produces traditional vehicle play action, with the skateboard traveling in a forward or reverse direction. This alignment is ideal for use on half pipes and jumps or traditional vehicle floor play. In another aspect, the flywheel is rotatable from 0 to 90 degrees (and anything in-between or beyond). The ability to adjust the angle of the flywheel yields even more unique performance and stunt capabilities.

In another aspect, the flywheel 104 can be positioned in a low clearance position, where the flywheel 104 is set below the plane formed by the four smaller wheels 110. Such a placement allows the flywheel 104 to touch the ground, thus transferring its rotational energy into movement of the board. Depending on the rotational positions of the flywheel 104 relative to the skateboard deck 108, this will induce different movement on the ground or playset. At 0 degrees, the mobile toy 102 moves in a standard forward/backward direction. In the 90 degree position, the mobile toy 102 moves laterally and appears to be doing big slides.

In yet another aspect, the flywheel can be positioned in a high clearance position, where the flywheel is set above the plane formed by the smaller four wheels. Such a placement raises the central axis of the flywheel, keeping the flywheel from touching the ground in the upright position, as well as moving the focal point of the gyroscopic action to different locations on the board. In the ideal case, with the wheel at 90 degrees, the axis of the flywheel now passes directly through the upturned 'tail' of the board, allowing it to spin like a top on one specific point. This also extends the time that it can spend 'floating' on the tail of the board before losing energy and returning to a flat position.

The shape of the skateboard deck also has performance benefits. Varying the profile of the skateboard can be used to induce variations to the tricks and stunt abilities. For example, notches and detents in the edges allow the board to perform rail slides and grinds. Single and double pointed noses create specific locations for the board to spin. Angles and flats in certain areas allow the board to settle into off-camber, angled, or vertical spins. There are other shapes and designs of both the skateboard deck and the frame that have yet to be explored, but are surely going to influence performance.

The flywheel can also be formed to give consideration to the profile, weight, and material of the flywheel. For example, maximizing weight is a key strategy to improving gyro performance and play duration.

As described previously, the present invention is directed to a stunt figure for attaching with a mobile toy (e.g., skateboard) and the corresponding mobile toy. While the material above is directed to various configurations of the mobile toy and flywheel, the shape and form of the stunt figure is equally important.

It should be noted that the stunt figure can be formed in a variety of shapes to represent a variety of "riders." The stunt figures are formed of any suitable lightweight material and in any suitable manner, a non-limiting example of which includes being formed of a moldable plastic with adhesive labels for art to depict the rider. The light weight of the stunt figures allows them to easily attach to the board without tipping the board. In a desired aspect, the stunt figures are substantially flat with the exception of a rib around the perimeter of the stunt figure for structural purposes. Thus, the entire stunt figure has a uniform thickness (with the exception of the rib). However, as can be appreciated by one skilled in the art, the stunt figure may also be formed to be multi-dimensional.

FIG. 1 depicts the mobile toy 102 and stunt figure 100 in a form to allow the stunt figure 100 to perform a "wheelie" and/or "tumbles." In this form, the stunt figure 100 is connected with the mobile toy 102 through at least one appendage, a non-limiting example of which includes a foot 111, as shown. Another appendage, shown as a hand 112, of the stunt figure 100 is placed back and behind the stunt figure. The hand 112 is formed such that when the stunt figure 100 is attached with the mobile toy 102, the outer tip of the hand 112 is aligned with the mobile toy 102 and/or the wheels 110 of the mobile toy 102. This alignment represents a ground surface when the mobile toy 102 is tipped back. Thus, the shape of the stunt figure 100 and the position of the hand 112 allows the stunt figure 100 to do "wheelies." Additionally, when jumping, the stunt figure 100 can help the mobile toy 102 perform flips and tumbles as well as assist in righting the mobile toy 102. Furthermore, the stunt figure can be formed so that only a foot of the stunt figure is connected with the mobile toy, while the other foot stands off of the mobile toy (not shown). The stunt figure can be turned around to change the connecting foot which will provide for a different performance.

Figure 2:
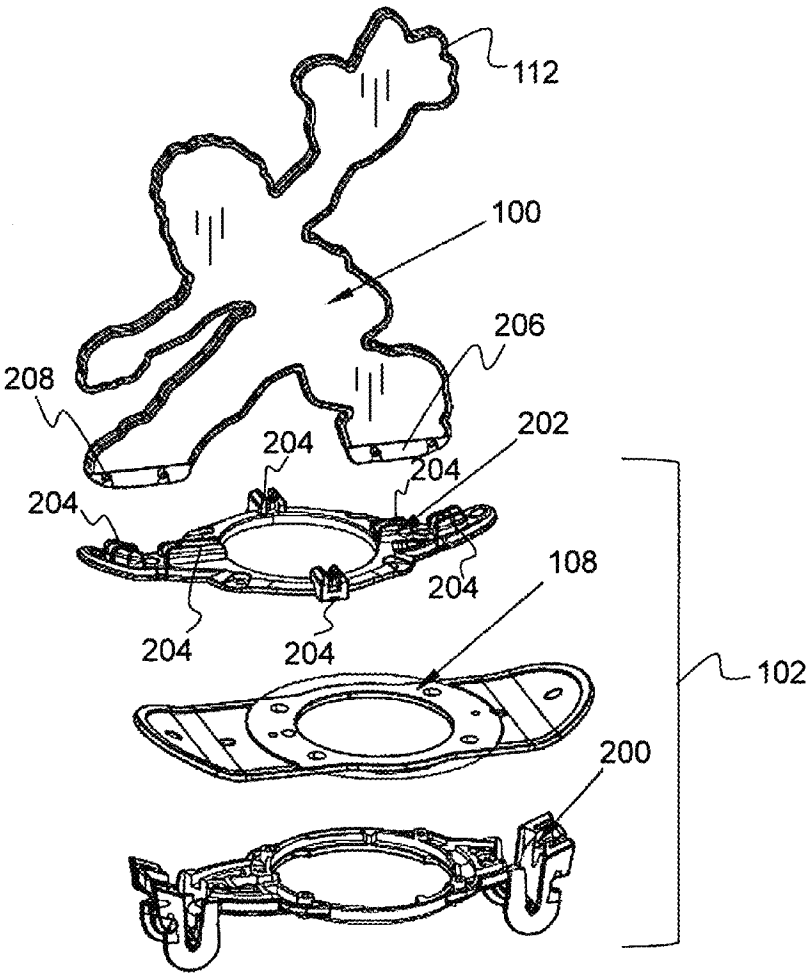
FIG. 2 illustrates an exploded-view of a mobile toy and a stunt figure for attachment with the mobile toy according to the present invention, depicting the connection mechanisms for attachment of the stunt figure with the mobile toy.

FIG. 2 depicts an exploded view of the stunt figure 100 and the mobile toy 102, formed as a skateboard. In a desired aspect and as shown in FIG. 2, the mobile toy 102 (flywheel not shown) includes a body member 200 where the four smaller wheels are housed. The skateboard deck 108 is attached with the top of the body member 200. A frame 202 (or bezel) is then connected with the top of the skateboard deck 108. The frame 202 includes at least one connection mechanism 204 by which the stunt figure 100 is detachably attached with the mobile toy 102.

The stunt figure 100 is attached with the mobile toy 102 using at least one of the connection mechanisms 204. The connection mechanism 204 is any suitable mechanism or device that allows the stunt figures 100 to be changed easily and placed in different locations for different performance, non-limiting examples of which include posts, slots, magnets, glue, clay, wax, etc. For example and as shown in FIG. 2, the stunt figure 100 may include at least one tab 206 (or post) at certain connection points while the mobile toy 102 includes several slots or holes to accommodate the stunt figure 100 in one or several configurations. In a desired aspect and as shown, the connection mechanisms 204 are formed as channels to receive a portion of the stunt figure 100. In a desired aspect, the connection mechanisms 204 are positioned radially around the frame 202 of the mobile toy 102. In another desired aspect, the tab 206 is a portion of an appendage (e.g., hand, foot) of the stunt figure 100 which is formed in the appropriate size and shape to be inserted into the connection mechanisms 204 through a snap-fit mechanism. As a non-limiting example, the tab 206 may include at least one indentation 208 which receives a protrusion formed in the connection mechanism 204.

Figure 3B:
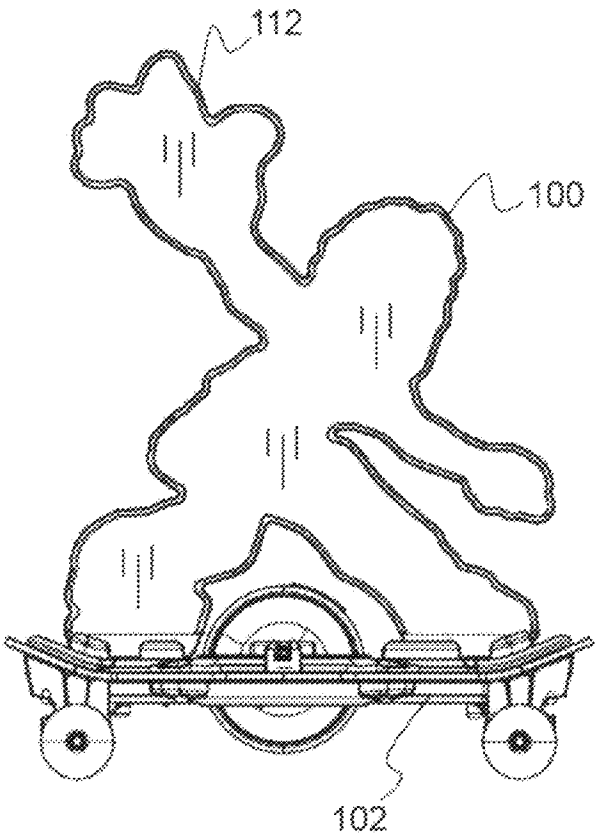
FIG. 3B illustrates a front-view of a stunt figure attached with a mobile toy according to the present invention, depicting the mobile toy and stunt figure in a form to allow the stunt figure to perform a "wheelie" and/or "tumbles"
Figure 3A:
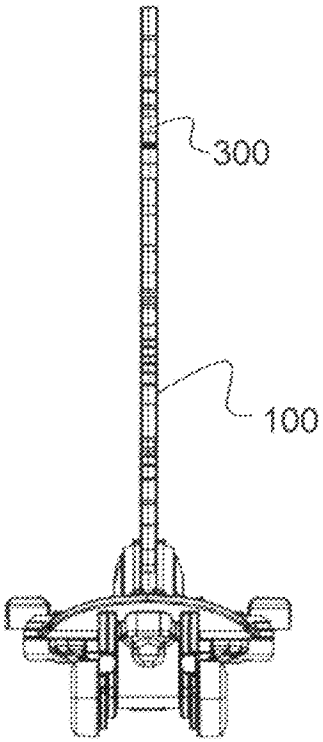
FIG. 3A illustrates a side-view of a stunt figure attached with a mobile toy according to the present invention, depicting the substantially flat structure of the stunt figure.

FIG. 3A illustrates a side-view of the stunt figure 100 shown in FIGS. 1 and 2. As described above, the stunt figure 100 is substantially flat with the exception of a rib 300 around the perimeter of the stunt figure 100 for structural purposes. FIG. 3B depicts a front-view of the same stunt figure 100. In another play feature, the hand 112 of the stunt figure 100 is formed to allow the stunt figure 100 to "catch" other items. For example, the stunt figure 100 can be formed with a "hooked hand" that allows the mobile toy 102 and stunt figure 100 to slide down rails or strings as well as "catch" other objects and play set features.

Figure 4:
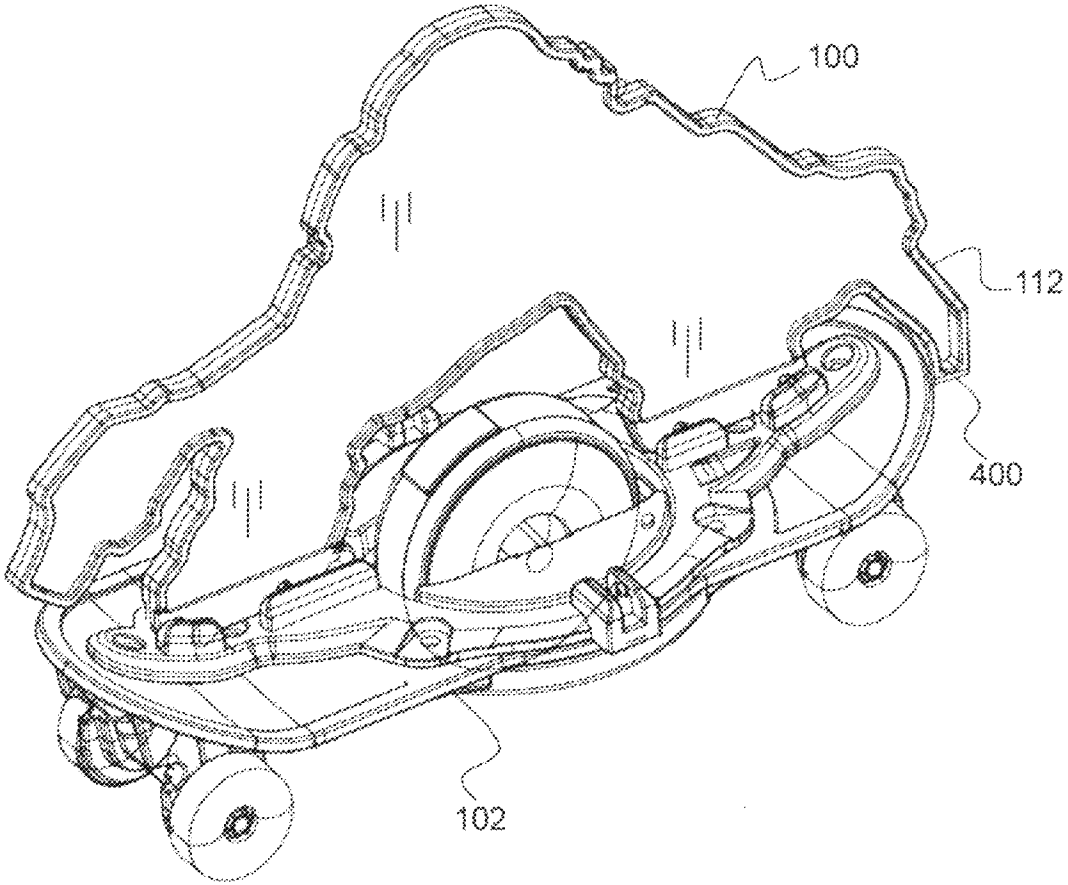
FIG. 4 illustrates a perspective-view of a stunt figure attached with a mobile toy according to the present invention, depicting the mobile toy and stunt figure in a form to allow the stunt figure to perform a "finger spin"
Figure 5:
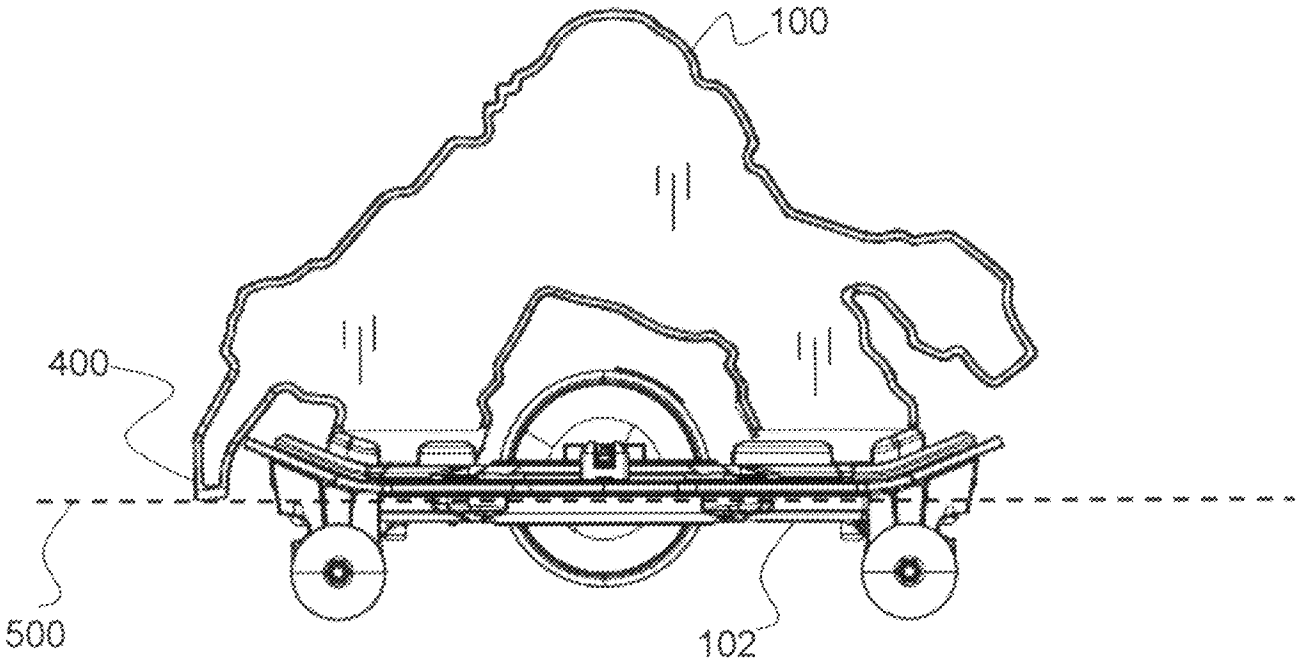
FIG. 5 illustrates a front-view of a stunt figure attached with a mobile toy according to the present invention, depicting the mobile toy and stunt figure in a form to allow the stunt figure to perform a "finger spin"

FIG. 4 depicts the mobile toy and stunt figure 100 in a form to allow the stunt figure 100 to perform a "finger spin." The shape and location of the hand 112 and a finger 400 allow the mobile toy 102 and stunt figure 100 to "spin" on the finger 400 tip. FIG. 5 illustrates a side-view of the same stunt figure 100, clearly depicting the position of the finger 400 away from the mobile toy 102 to assist in performing finger spins. As shown, the finger 400 is aligned with a central axis 500 of the toy 102 that is formed as a center of gravity between the stunt figure 100 and the toy 102.

Figure 6:
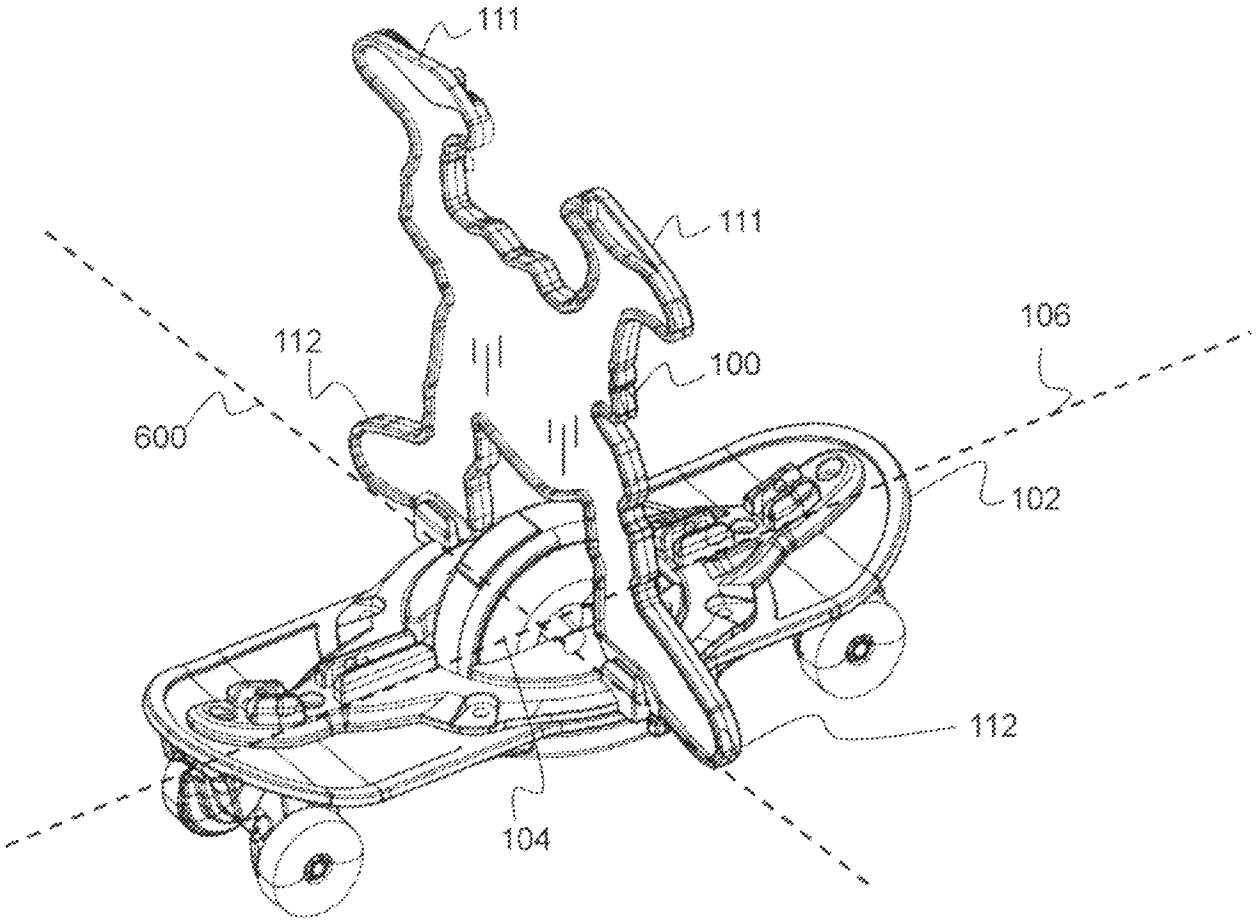
FIG. 6 illustrates a perspective-view of a stunt figure attached with a mobile toy according to the present invention, depicting the mobile toy and stunt figure in a form to allow the stunt figure to perform a "hand stand"
Figure 7:
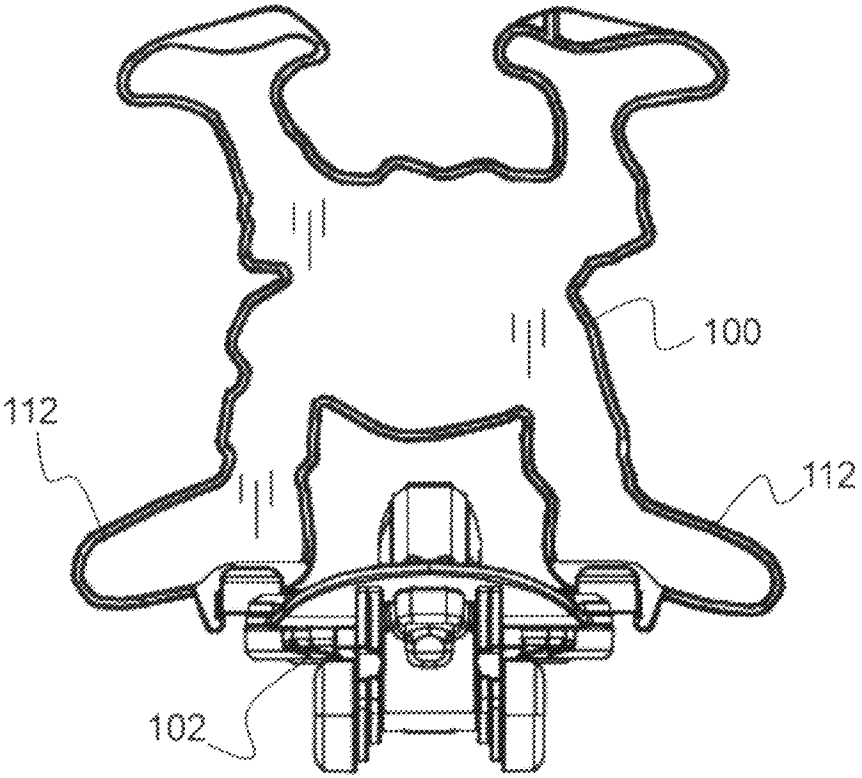
FIG. 7 illustrates a front-view of a stunt figure attached with a mobile toy according to the present invention, depicting the mobile toy and stunt figure in a form to allow the stunt figure to perform a "hand stand".

FIG. 6 depicts the mobile toy 102 and stunt figure 100 in a form to allow the stunt figure 100 to perform a "handstand." As shown, the stunt figure 100 is in a different form with hands 112 that are connected with the mobile toy 102 and feet 111 extended out for contact with a ground surface. It should also be noted that the stunt figure's 100 position (or orientation 600) is a 90 degree angle to the long axis 106 of the mobile toy 102. With the stunt figure 100 in this position, the stunt figure 100 can do "handstands" by balancing on the hands 112 and sliding around. As the flywheel 104 slows down, the rider can flip back over into an upright position. FIG. 7 is a front-view illustration of the stunt figure 100 shown in FIG. 6, depicting the positioning of the hands 112 of the stunt figure 100 on either side of the mobile toy 102.

Thus, based on the above, it can be appreciated by one skilled in the art that the present invention includes a mobile toy (e.g., flywheel powered miniature skateboard) and a stunt figure for attaching with the mobile toy. The position and shape of the stunt figure provides for a wide variety of stunts that can be performed with the mobile toy by altering the shape and center of gravity of the mobile toy. Although not depicted, it can also be appreciated that the stunt figure can be posable such that it can be bent or positioned into and fixed in a particular form to provide the features described herein.

What is claimed is:

1. A mobile toy, comprising:

a skateboard-shaped toy having a skateboard deck with a flywheel positioned within the skateboard deck;

wherein the flywheel has a rotational axis, and the flywheel is repositionable with respect to the skateboard deck, such that repositioning the flywheel within the skateboard deck alters the rotational axis of the flywheel with respect to the skateboard deck;

wherein the flywheel is rotatable within the skateboard deck with respect to a long axis of the skateboard-shaped toy between a first position and a second position, such that at the first position, the flywheel is aligned such that it rotates in a direction that is aligned with the long axis of the skateboard-shaped toy, with the axis of rotation when in the first position being perpendicular to the long axis of the skateboard-shaped toy and substantially horizontal with a ground surface;

wherein when in the second position, the flywheel is aligned such that it rotates in a direction that is perpendicular to the long axis of the skateboard-shaped toy, with the axis of rotation being aligned with the long axis of the skateboard-shaped toy; and a stunt figure for attaching with the skateboard-shaped toy, the stunt figure having at least two appendages, and wherein the flywheel is positioned within the skateboard deck such that at least a portion of the flywheel protrudes above a top surface of the skateboard deck and resides between the at least two appendages when the stunt figure is attached with the skateboard-shaped toy.

2. The mobile toy as set forth in claim 1, wherein the stunt figure is detachably attachable with the skateboard-shaped toy and repositionable on the skateboard-shaped toy to alter a performance ability of the skateboard-shaped toy.

3. The mobile toy as set forth in claim 2, wherein the stunt figure is detachably attachable with the skateboard-shaped toy via a connection mechanism.

4. The mobile toy as set forth in claim 3, wherein the connection mechanism is a snap-fit mechanism.

5. The mobile toy as set forth in claim 4, wherein the stunt figure is attached with the skateboard-shaped toy via the at least two appendages.

6. The mobile toy as set forth in claim 5, wherein the skateboard-shaped toy further comprises a frame attached with the skateboard deck and a pair of channels attached with the frame receiving at least a portion of the at least two appendages of the stunt figure.

7. The mobile toy as set forth in claim 1, wherein the stunt figure is attached with the skateboard-shaped toy via the at least two appendages.

8. The mobile toy as set forth in claim 1, wherein the skateboard-shaped toy further comprises a frame and at least one channel in the frame for receiving at least a portion of the stunt figure.

9. A method for forming a mobile toy, comprising acts of:

forming a skateboard-shaped toy having a skateboard deck with a flywheel having a rotational axis positioned within the skateboard deck;

wherein the skateboard-shaped toy is formed such that the flywheel is repositionable with respect to the skateboard deck, such that repositioning the flywheel within the skateboard deck alters the rotational axis of the flywheel with respect to the skateboard deck;

wherein the flywheel is rotatable within the skateboard deck with respect to a long axis of the skateboard-shaped toy between a first position and a second position, such that at the first position, the flywheel is aligned such that it rotates in a direction that is aligned with the long axis of the skateboard-shaped toy, with the axis of rotation when in the first position being perpendicular to the long axis of the skateboard-shaped toy and substantially horizontal with a ground surface;

wherein when in the second position, the flywheel is aligned such that it rotates in a direction that is perpendicular to the long axis of the skateboard-shaped toy, with the axis of rotation being aligned with the long axis of the skateboard-shaped toy; and forming a stunt figure for attaching with the skateboard-shaped toy, the stunt figure having at least two appendages, and wherein the flywheel is positioned within the skateboard deck such that at least a portion of the flywheel protrudes above a top surface of the skateboard deck and resides between the at least two appendages when the stunt figure is attached with the skateboard-shaped toy.

10. The method for forming the mobile toy as set forth in claim 9, further comprising an act of forming the stunt figure to be detachably attachable with the skateboard-shaped toy and repositionable on the skateboard-shaped toy to alter a performance ability of the skateboard-shaped toy.

11. The method for forming the mobile toy as set forth in claim 10, further comprising an act of forming the stunt figure to be detachably attachable with the skateboard-shaped toy via a connection mechanism.

12. The method for forming the mobile toy as set forth in claim 11, further comprising an act of forming the connection mechanism as a snap-fit mechanism.

13. The method for forming the mobile toy as set forth in claim 12, further comprising an act of attaching the stunt figure with the skateboard-shaped toy via the at least two appendages.

14. The method for forming the mobile toy as set forth in claim 13, further comprising an act of forming the skateboard-shaped toy with a frame attached with the skateboard deck and a pair of channels in the frame for receiving at least a portion of the at least two appendages of the stunt figure.

15. The method for forming the mobile toy as set forth in claim 9, further comprising an act of attaching the stunt figure with the skateboard-shaped toy via the at least two appendages.

16. The method for forming the mobile toy as set forth in claim 9, further comprising an act of forming the skateboard-shaped toy with a frame and at least one channel in the frame for receiving at least a portion of the stunt figure.

17. The mobile toy as set forth in claim 6, wherein the frame comprises a plurality of channels positioned radially around the frame to allow for repositioning of the stunt figure on the frame.

18. The mobile toy as set forth in claim 8, wherein the frame comprises a plurality of channels positioned radially around the frame to allow for repositioning of the stunt figure on the frame.

19. The method for forming the mobile toy as set forth in claim 14, further comprising an act of forming a plurality of channels positioned radially around the frame to allow for repositioning of the stunt figure on the frame.

20. The method for forming the mobile toy as set forth in claim 16, further comprising an act of forming a plurality of channels positioned radially around the frame to allow for repositioning of the stunt figure on the frame.

* * * * *